US006782584B2

(12) United States Patent
Choi

(10) Patent No.: US 6,782,584 B2
(45) Date of Patent: Aug. 31, 2004

(54) UPRIGHT TYPE VACUUM CLEANER

(75) Inventor: Min-Jo Choi, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 344 days.

(21) Appl. No.: 10/139,016

(22) Filed: May 3, 2002

(65) Prior Publication Data

US 2003/0145421 A1 Aug. 7, 2003

(30) Foreign Application Priority Data

Feb. 6, 2002 (KR) ..... 2002-6639

(51) Int. Cl.[7] ..... A47L 9/16

(52) U.S. Cl. ..... 15/352; 15/353; 55/337; 55/429; 55/DIG. 3

(58) Field of Search ..... 15/350, 351, 352, 15/353; 55/337, 429, 459.1, 486, DIG. 3

(56) References Cited

U.S. PATENT DOCUMENTS 4,571,772 A * 2/1986 Dyson ..... 15/335
5,145,499 A * 9/1992 Dyson ..... 55/337
6,589,309 B2 * 7/2003 Oh et al. ..... 55/429
6,732,406 B2 * 5/2004 Oh ..... 15/352
6,735,816 B2 * 5/2004 Oh et al. ..... 15/353
2002/0088079 A1 * 7/2002 Oh ..... 15/352
2002/0092283 A1 * 7/2002 Oh et al. ..... 55/429
2002/0178535 A1 12/2002 Oh et al.
2003/0221278 A1 * 12/2003 Oh ..... 15/352
2003/0221279 A1 * 12/2003 Oh et al. ..... 15/353

FOREIGN PATENT DOCUMENTS

GB 2376175 12/2002

* cited by examiner

*Primary Examiner*—Terrence R. Till
(74) *Attorney, Agent, or Firm*—Ladas & Parry

(57) ABSTRACT

An upright type vacuum cleaner has a cleaner body having a vacuum generating apparatus disposed therein and a suction brush disposed at a lowerportion; a cyclone unit for separating contaminants from contaminant-laden air and discharging a contaminant-free air through an outflow passage interconnected with the vacuum generating apparatus, the contaminant-laden air being drawn in through an inflow passage interconnected with the suction brush; a dust receptacle removably connected to an underside of the cyclone unit for collecting the contaminants separated by the cyclone unit; a longitudinally movable locking unit for connecting to and separating the dust receptacle from a lower portion of the cyclone unit by longitudinally moving the dust receptacle upward and downward; and a means for preventing an incorrect connection of the dust receptacle to the lower side of the cyclone unit.

5 Claims, 6 Drawing Sheets

UPRIGHT TYPE VACUUM CLEANER

REFERENCE TO RELATED INVENTION

This invention is related to co-pending U.S. patent application Ser. No. 10/074,161, filed on Feb. 12, 2002, now U.S. Pat. No. 6,735,816, issued May 18, 2004.

BACKGROUND OF THE INVENTION

1. Field of the Invention

The present invention relates generally to an upright type vacuum cleaner, and more particularly, to an upright type vacuum cleaner having a cyclone unit for separating contaminants from contaminant-laden air by a centrifugal force that is formed through a revolving stream of drawn air.

2. Description of the Related Art

FIG. 1 shows an upright type vacuum cleaner, such as is disclosed in the U.S. patent application Ser. No. 10/074,161 filed Feb. 12, 2002, now U.S. Pat. No. 6,735,816, issued May 18, 2004 and hereby incorporated by reference herein. The upright type vacuum cleaner of FIG. 1 includes a cleaner body 10, a cyclone unit 20 and a dust receptacle 30.

Inside body 10 of the cleaner, a vacuum generating apparatus, i.e., a driving motor (not shown) is mounted. Attached to the underside 12 of the cleaner body 10, a suction brush (not shown) is movably connected. In the front portion of the center of the cleaner body 10, a cyclone housing portion 13 is formed.

The cyclone unit 20 has an inflow passage 21 formed on an upper side that is interconnected through a pipe 14 with the suction brush 12. The contaminants, drawn in from the surface to be cleaned by action of the suction brush 12, flow into the cyclone unit 20 in the air stream via the inflow passage 21. At this time, the air flows into a whirling current along an inner wall of the cyclone unit 20.

The cyclone unit 20 has an outflow passage 22 formed on an upper portion of the center of the cyclone unit 20, interconnected through a pipe 15 with the vacuum generating apparatus. After the contaminants are removed, the air is discharged from the cyclone unit 20 outside the cleaner body 10 through the outflow passage 22 and the vacuum generating apparatus.

The cyclone unit 20 housed in the cyclone housing portion 13 and includes a locking handle 23 for securely mounting the cyclone unit 20 onto the cleaner body 10. The locking handle 23 is inserted into a handle connection portion 16 of the rear wall of cyclone housing portion 13 and is pivoted by 90° so as to fix the cyclone unit 20 in place.

In this locking operation, the dust receptacle 30 is removably mounted to the lower portion of the cyclone unit 20, and together these are mounted onto the cyclone housing portion 13. That is, with the dust receptacle 30 being disposed at the lower portion of the cyclone unit 20, and by pivoting an operation lever 41 of a locking unit 40 mounted on the lower portion of the cyclone housing portion 13, a locking disc 42 is transposed in the direction of pivoting, mounting or separating the dust receptacle 30 on/from the lower portion of the cyclone unit 20.

Accordingly, without having to separate the cyclone unit 20 from the cleaner body 10, i.e., by separating only the dust receptacle 30, a user can remove and empty the dust receptacle 30.

However, a problem occurs when the user inadvertently incorrectly connects the dust receptacle 30 to the cyclone housing portion 13. That is, the dust receptacle 30 may be incompletely inserted into the cyclone housing portion 13, causing inaccurate alignment with the lower portion of the cyclone unit 20. In this case, the user cannot turn the operation lever 41, and if the user forcefully tries to turn the operation lever 41, the dust receptacle 30 and/or the operation lever 41 may become deformed or broken. If the cleaner is operated with the dust receptacle 30 being incorrectly mounted, some contaminants may leak through a crack caused by the incompletely or incorrectly connected dust receptacle 30 and the cyclone unit 20, and the process of collecting into the dust receptacle 30 may contaminate the neighboring area.

SUMMARY OF THE INVENTION

The present invention has been made to overcome the above-mentioned problems of the prior art. Accordingly, it is an object of the present invention to provide an upright type vacuum cleaner having an improved structure, which is capable of preventing incorrect mounting of a dust receptacle during the mounting process.

The above object is accomplished by an upright type vacuum cleaner according to the present invention, including a cleaner body having a vacuum generating apparatus disposed therein and a suction brush disposed at a lower side; a cyclone unit for separating contaminants from a contaminant-laden air and discharging a contaminant-free air through an outflow passage interconnected with the vacuum generating apparatus, the contaminant-laden air being drawn in through an inflow passage interconnected with the suction brush; a dust receptacle removably connected to a underside of the cyclone unit for collecting the contaminants separated by the cyclone unit from the air; a locking unit which is longitudinally movable, for connecting to and separating the dust receptacle from a lower portion of the cyclone unit by longitudinally moving the dust receptacle upward and downward; and a means for preventing an incorrect connection of the dust receptacle to the underside of the cyclone unit.

The incorrect connection preventing means includes a position guiding pin protruding from a predetermined location of a lower portion of the dust receptacle; and a guide slit formed at a predetermined position of the locking unit, for either interrupting pivoting of the locking unit, or for guiding the dust receptacle being moved from a pre-mounting state to be separated from the cyclone unit, depending on whether the dust receptacle is correctly pre-mounted in the cyclone unit.

The locking unit includes an operation lever pivotally mounted in the cleaner body; and a locking disc moved upward or downward according to the pivoting of the operation lever to move the dust receptacle upward to engage the cyclone unit or downward to disengage from the cyclone unit.

The incorrect connection preventing means includes: a position guiding pin protruding from a predetermined location of the lower side of the dust receptacle; and a guide slit formed in the operation lever, for either interrupting pivoting of the operation lever, or for guiding the dust receptacle being moved from a pre-mounting state so as to separate from the cyclone unit, depending on whether the dust receptacle is correctly pre-mounted in the cyclone unit.

The guide slit includes a first guide slit formed in an upper surface of the operation lever in a predetermined width, such that the guide pin is passed through the first guide slit during pivoting of the operation lever with the dust receptacle being in a normal position; a second guide slit extending from the first guide slit and crossing the direction of pivoting of the operation lever for guiding the guide pin to separate the dust receptacle from the cyclone unit when the dust receptacle is incorrectly mounted; and an interruption groove formed between the first and second guide slits for interrupting the guide pin during pivoting of the operation lever to thereby interrupt the pivoting when the dust receptacle is in an abnormal position.

BRIEF DESCRIPTION OF THE DRAWINGS

The above-mentioned objects and the feature of the present invention will be more apparent by describing the preferred embodiment of the present invention by referring to the appended drawings, in which.

DETAILED DESCRIPTION OF THE PREFERRED EMBODIMENT

The preferred embodiment of the present invention will be described below in greater detail by referring to the appended drawings.

Figure 1:
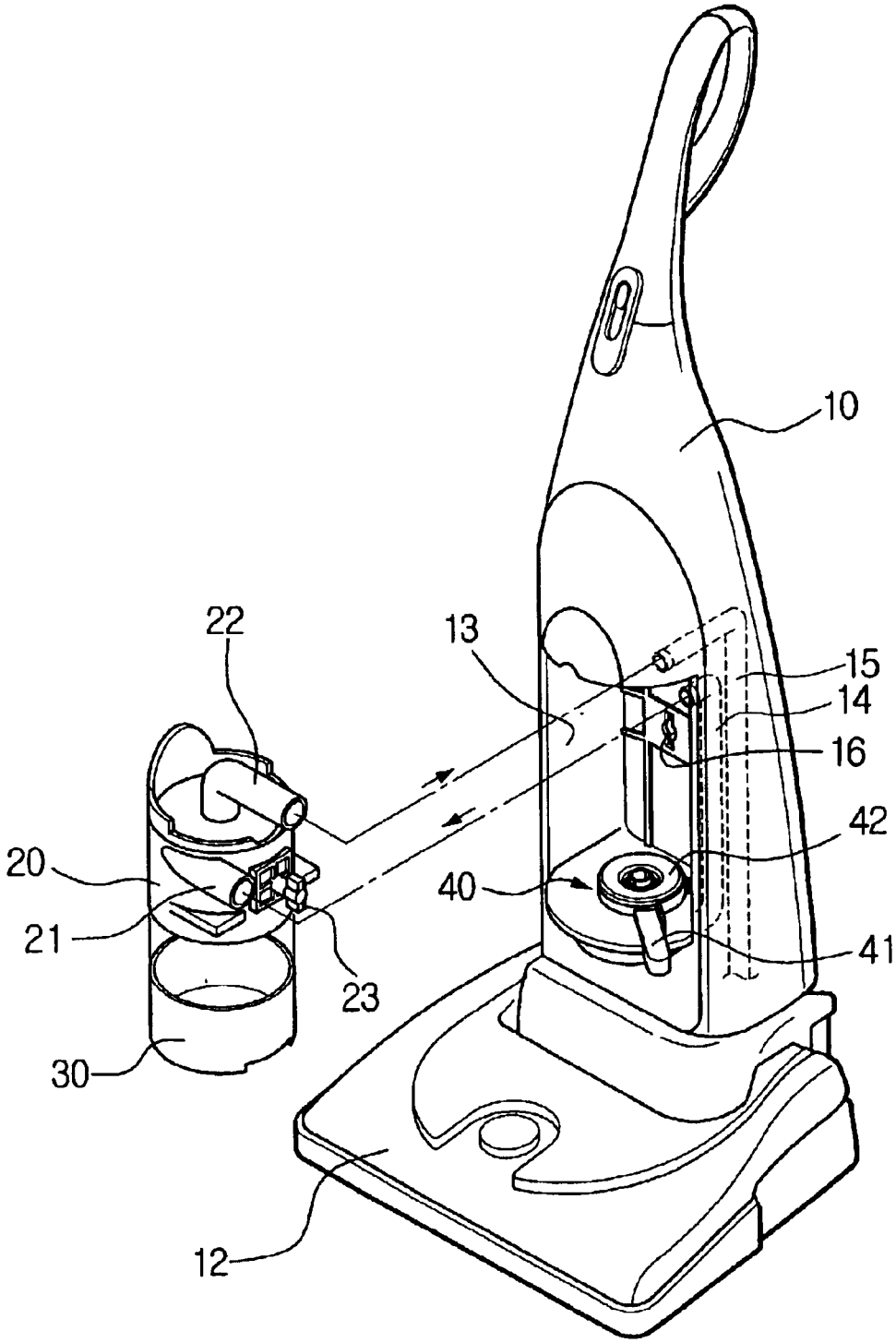
FIG. 1 is an exploded perspective view of the upright type vacuum cleaner disclosed in related patent application Ser. No. 10/074,161, filed Feb. 12, 2002 now U.S. Pat. No. 6,735,816, issues May 18, 2004.
Figure 2:
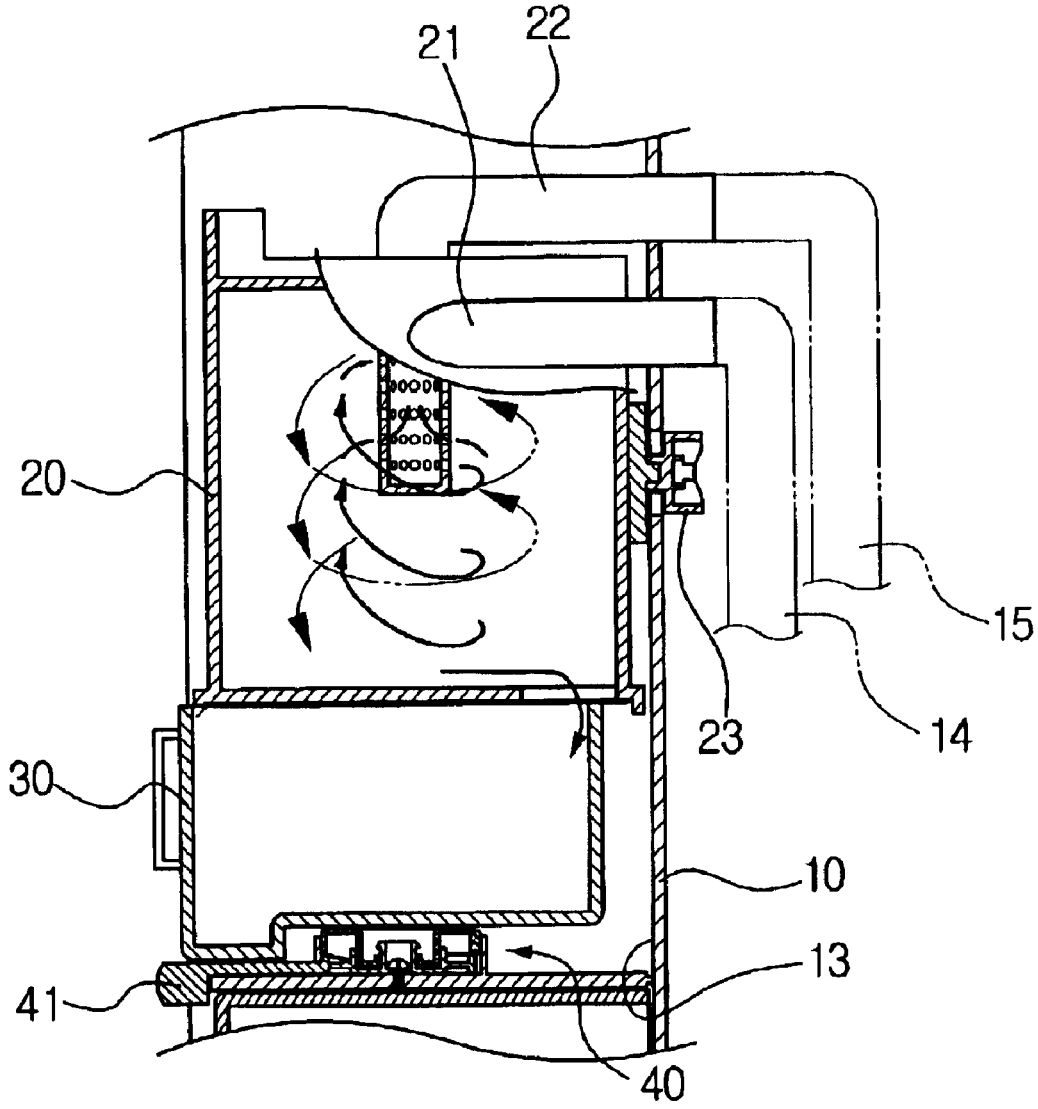
FIG. 2 is a sectional view schematically showing the upright type vacuum cleaner of FIG. 1 in operation following assembly.
Figure 3:
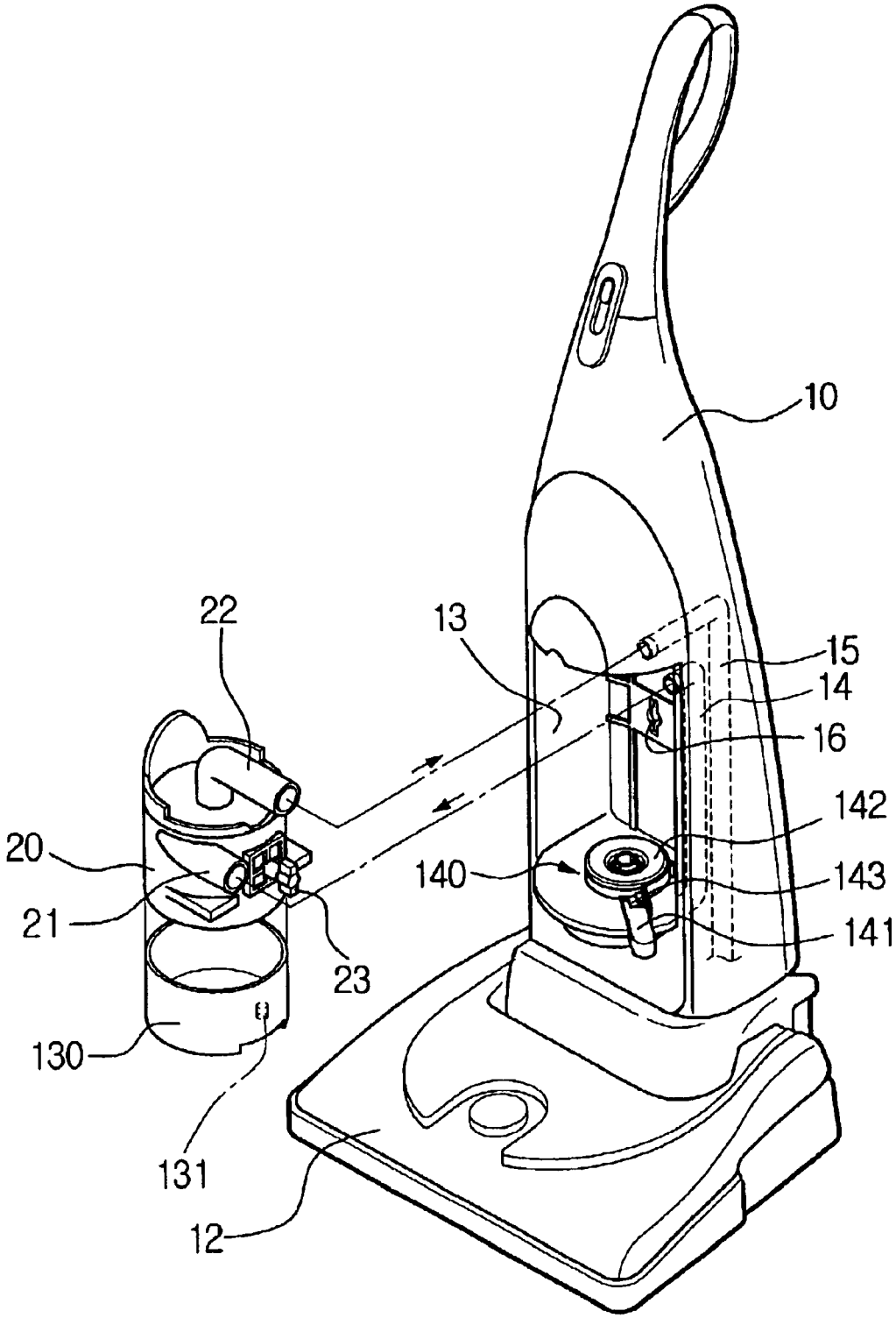
FIG. 3 is an exploded perspective view showing an upright type vacuum cleaner according to the preferred embodiment of the present invention.

FIG. 3 shows an upright type vacuum cleaner according to the preferred embodiment of the present invention. Also, throughout the description, like elements are given the same reference numerals.

The upright type vacuum cleaner according to the present invention includes a cleaner body 10, a cyclone unit 20, a dust receptacle 130, a movable locking unit 140 and a dust receptacle incorrect mounting preventing means.

The cleaner body 10 has a vacuum generating apparatus (not shown) disposed therein. The cleaner body 10 also has a suction brush (not shown) formed at the lower side 12 thereof. The cleaner body 10 also comprises a cyclone housing portion 13 formed at the front portion of the center of the cleaner body 10.

The cyclone unit 20 has an inflow passage 21 formed on the upper side, which is interconnected with the suction brush through a tube 14 (shown in phantom). Accordingly, the air and contaminants are drawn in through the suction brush, and into the cyclone unit 20 via the inflow passage 21.

The inflow passage 21 is formed such that the air, which passes through the inflow passage 21, is drawn into the cyclone unit 20 in a tangential direction. Accordingly, after the air flows through the inflow passage 21, the air is formed into a whirling current rotating along the inner sidewall of the cyclone unit 20.

The cyclone unit 20 also has an outflow passage 22 formed on the center of the upper side of the cyclone unit 20, which is interconnected with the vacuum generating apparatus through a tube 15 (shown in phantom). When the contaminants are removed from the air, the clean air is discharged from the cleaner body 10 through the outflow passage 22 and to the environment outside of the vacuum generating apparatus.

The pair of tubes 14, 15 disposed between the cyclone housing portion 13 and the vacuum generating apparatus, and between the cyclone housing portion 13 and the suction brush, respectively, having one set of outlet ends being connected to the inner sidewall of the cyclone housing portion 13 and the other set of outlet ends being respectively connected to the vacuum generating apparatus and to the suction brush. The pair of tubes 14, 15 are positioned such that the ends connected to the cyclone housing portion 13 face forward within the cyclone housing portion 13.

Corresponding to the forward-facing ends of the tubes 14, 15, the inflow passage 21 and the outflow passage 22 of the cyclone unit 20 are arranged in parallel with each other to face backward during the insertion step. Accordingly, simply by inserting the cyclone unit 20 horizontally into the cyclone housing portion 13, the inflow passage 21 and the outflow passage 22 become connected with the pair of tubes 14, 15, respectively.

A locking handle 23 is pivotally disposed on the outside of the rear portion of the cyclone unit 20 so as to be accessible from the back of the cleaner body 10. A handle connecting portion 16 is formed on the cleaner body 10 corresponding to the locking handle 23. Accordingly, the cyclone unit 20 is securely mounted in the cleaner body 10 by inserting the locking handle 23 through the handle connecting portion 16, while joining the passages 21 and 22 to the pair of tubes 14, 15, respectively, and turning the locking handle 23 by 90°.

The dust receptacle 130 is removably connected to the lower side of the cyclone unit 20. More specifically, with the cyclone unit 20 being mounted in the cyclone housing portion 13 of the cleaner body 10, the dust receptacle 130 is pre-mounted on the lower portion of the cyclone unit 20 and then raised within the cyclone housing portion 13 to complete the connection with the cyclone unit 20 through a manipulation of the movable locking unit 140, as described below. Contaminants, which are separated from the air in the cyclone unit 20, are collected in the dust receptacle 130, and a user can empty the dust receptacle 130 with convenience by simply separating and removing the dust receptacle 130 only.

Figure 4:
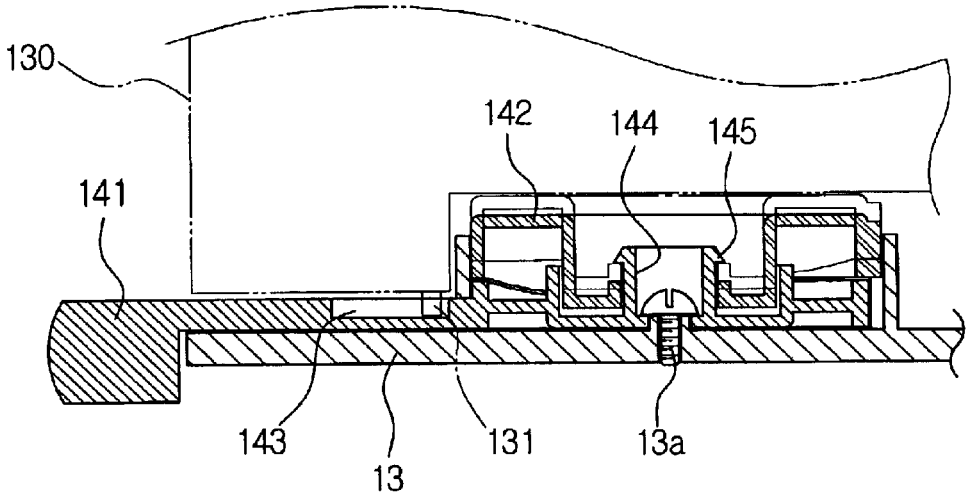
FIG. 4 is a sectional detail view showing an important feature of the upright type of FIG. 3.
Figure 5:
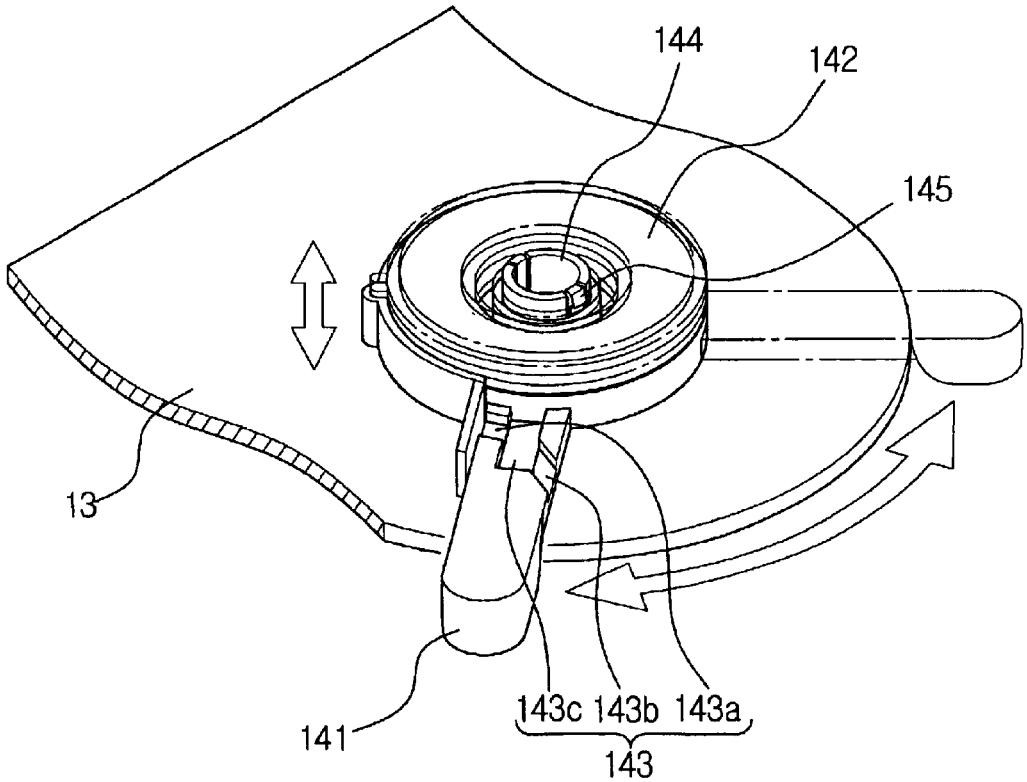
FIG. 5 is a perspective view showing a movable locking unit of the upright type vacuum cleaner of FIG. 4.

As shown in detail in FIGS. 4 and 5, the movable locking unit 140 is disposed on the lower side of the cyclone housing portion 13 such that the dust receptacle 130 is removably connected to the lower side of the cyclone unit 20 by the locking unit 140.

The locking unit 140 has an operation lever 141 and a locking disc 142. The operation lever 141 is pivotally connected to a hinge shaft 13*a* disposed at a lower surface of the cyclone housing portion 13, so that the lever 141 can pivot in the direction of the curved arrow (FIG. 5).

A hollow shaft, for example, another hinge shaft 144, protrudes upward from the center of the operation lever 141, enabling the longitudinal upward and downward movement of the locking disc 142 in the direction of the vertically extending arrow (FIG. 5). A cantilevered hook 145 provides a catch for preventing separation of the locking disc 142 from the hinge shaft 144.

The operation lever 141 has a cam portion formed on an upper surface, while the locking disc 142 also has a cam portion formed on a lower surface corresponding to the cam portion of the operation lever 141. By the interrelated movement of the cam portions of the operation lever 141 and the locking disc 142, the locking disc 142 is moved vertically upward or downward along the hinge shaft 144.

Figure 6:
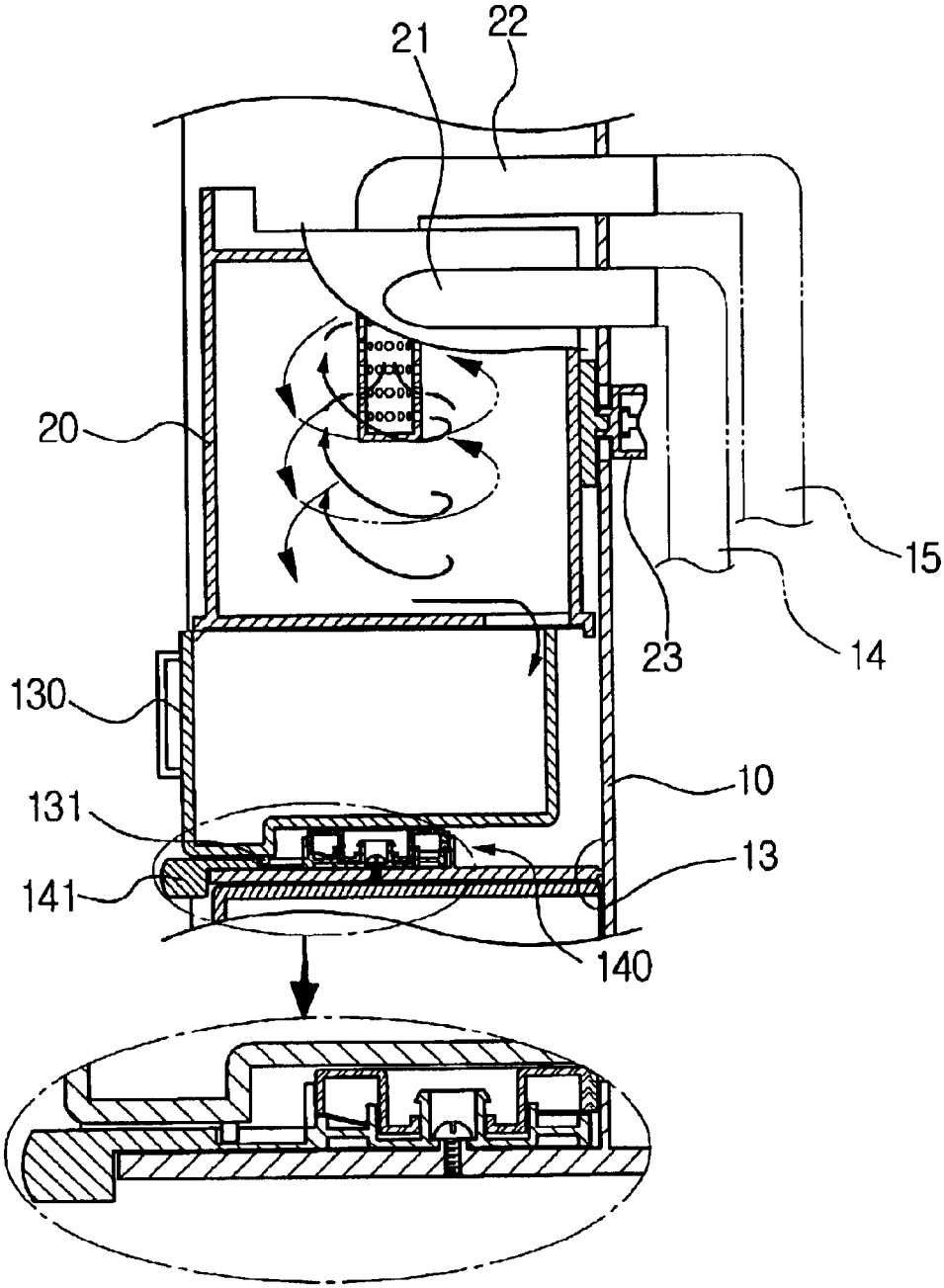
FIGS. 6 through 8 are views for respectively illustrating various situations in which the dust receptacle is incorrectly mounted in the vacuum cleaner.

Accordingly, as shown in FIG. 6, if the operation lever 141 is turned toward the left, the locking disc 142 is lowered to thereby unlock the connection with the cyclone unit 20 and the dust receptacle 130. If the operation lever 141 is turned rightward, the locking disc 142 is vertically raised to thereby lock the connection.

The incorrect mounting preventing means prevents the dust receptacle 130 from being unfittingly connected to the lower side of the cyclone unit 20.

The incorrect mounting preventing means includes a position guiding pin 131 protruding from a certain position of the lower portion of the dust receptacle 130, and a guide slit 143 formed in the operation lever 141 of the locking unit 140 to provide for a predetermined shape. The guide slit 143 is shaped and dimensioned to either interrupt the pivoting of the locking unit 140 or to guide the dust receptacle 130 as it is moved from the pre-mounting position and thereby separating it from the cleaner body 10, according to whether the position of the dust receptacle 130 is correctly or incorrectly pre-mounted in the cyclone unit 20. The guide slit 143 includes a first guide slit 143*a*, a second guide slit 143*b* and an interruption groove 143*c*.

As shown in FIG. 5, the first guide slit 143*a* is formed in a predetermined width in the direction of pivoting of the operation lever 141, so as not to interrupt movement of the guide pin 131 during pivoting of the operation lever 141 when the dust receptacle 130 is in a normal position.

The second guide slit 143*b* is formed in the operation lever 141, so as to extend from the first guide slit 143*a* and to cross the direction of the pivoting of the operation lever 141. If the dust receptacle 130 is incorrectly mounted, the guide pin 131 is transposed in the second guide slit 143*b*. In this situation, if the operation lever 141 is pivoted, the guide pin 131 is guided along the second guide slit 143*b* to be separated from the operation lever 141. In other words, if the dust receptacle 130 is incorrectly mounted, the dust receptacle 130 is separated from the cyclone housing portion 13.

The interruption groove 143*c* is disposed between the first and second guide slits 143*a* and 143*b*, to interrupt the guide pin 131 and the pivoting of the operation lever 141 when the dust receptacle 130 is not in the normal position. The interruption groove 143*c* is formed along the length of the operation lever 141, and is interconnected with the first and second guide slits 143*a* and 143*b*.

With the upright type vacuum cleaner constructed according to the present invention, when a user attempts to mount the cyclone unit 20 and the dust receptacle 130 into the cleaner body 10, first, the user securely mounts the cyclone unit 20 in the cyclone housing portion 13 of the cleaner body 10 by using the locking handle 23. After that, as shown in FIG. 5, with the operation lever 141 being pivoted toward the left in the direction of the curved arrow, the user fits the dust receptacle 130 in the cyclone housing portion 13 of the cleaner body 10.

Figure 7:
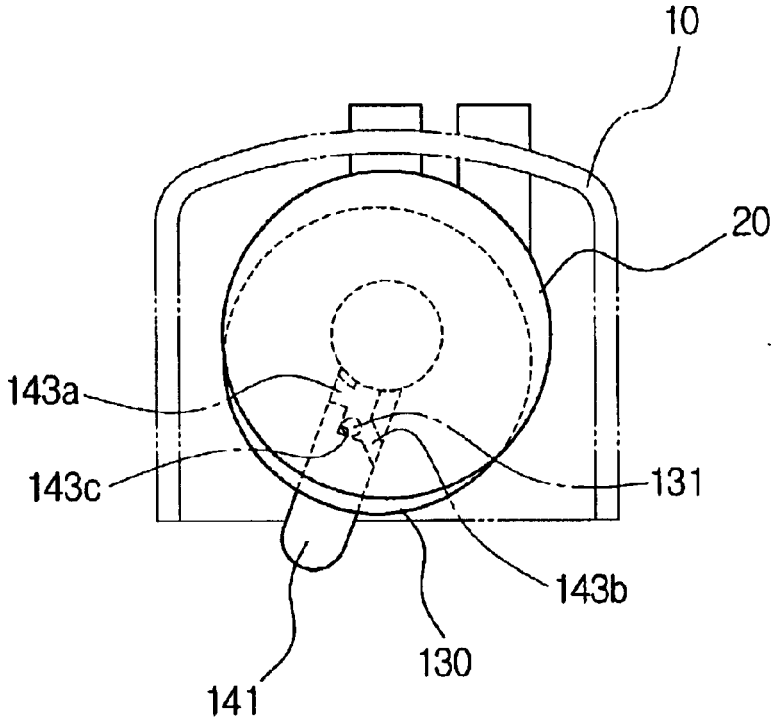
Figure 8:
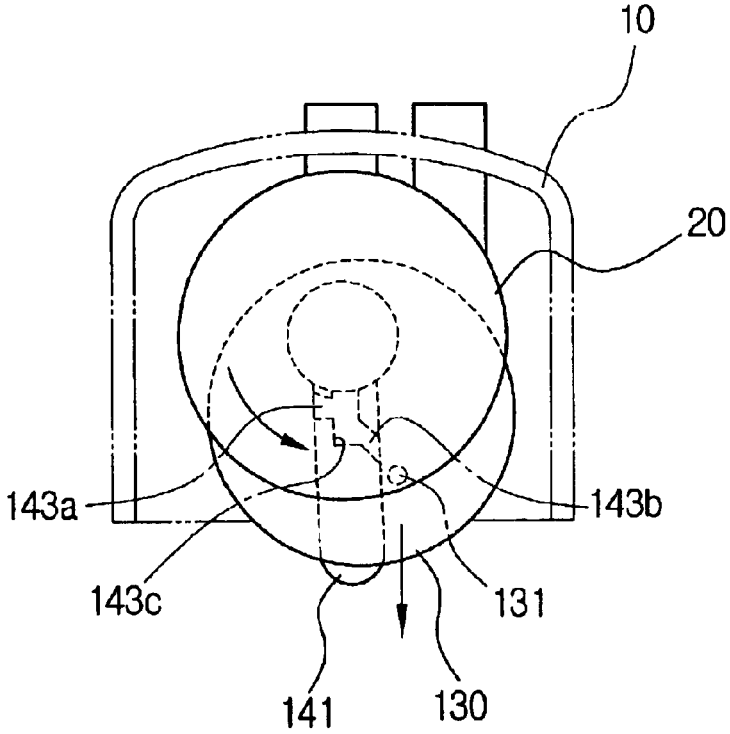

At this time, as shown in FIGS. 7 and 8, the dust receptacle 130 can be misaligned with respect to the position of the cyclone unit 20 due to an inadvertent mistake. If this happens, the guide pin 131 is not transposed into the first guide slit 143*a*, but instead is placed in either of the second guide slit 143*b* or in the interruption groove 143*c*. Then, as the operation lever 141 is turned toward the right, as shown in FIG. 8, the guide pin 131 of the dust receptacle 130 is interrupted by the second guide slit 143*b* and the interruption groove 143*c* to be separated from the cyclone housing portion 13.

As described above, unlike in the conventional examples, in which the dust receptacle 130 may be incorrectly mounted in the cyclone housing portion 13 by the force of the user, thus causing breakage or deformation of the structure, the dust receptacle 130 according to the present invention separates from the cyclone housing portion 13 when the user forcefully turns the operation lever 141, even when having no knowledge of the incorrect-mounting of the dust receptacle 130. Accordingly, damage to the parts due to the incorrect mounting of the dust receptacle 130 can be prevented. Also, there is no a crack between the dust receptacle 130 and the cyclone unit 20 when the vacuum cleaner dust receptacle 130 is incorrectly mounted so as to avoid any leakage of contaminant therethrough.

Meanwhile, when the dust receptacle 130 is in a normal position corresponding to the cyclone unit 20, the guide pin 131 engages the corresponding first guide slit 143*a*. Accordingly, by pivoting the operation lever 141, the dust receptacle 130 is raised and the connection with the cyclone unit 20 is made, with the guide pin 131 movement being uninterrupted.

As described above, the upright type vacuum cleaner according to the present invention is capable of preventing the incorrect mounting-fit of the dust receptacle 130 in the cyclone unit 20 when the dust receptacle 130 is mounted in the cyclone unit 20.

Since the damage to the parts or abnormal operation of the cleaner by the incorrect mounting of the dust receptacle 130 is prevented, product reliability increases.

Although the preferred embodiment of the present invention has been described, it will be understood by those skilled in the art that the present invention should not be limited to the described preferred embodiment, but various changes and modifications can be made within the spirit and scope of the present invention, as defined by the appended claims.

What is claimed is:

1. An upright type vacuum cleaner, comprising:

a cleaner body having a vacuum generating apparatus disposed therein and a suction brush disposed at a lower portion thereof;

a cyclone unit for separating contaminants from contaminant-laden air being drawn into the cleaner body and discharging a contaminant-free air through an outflow passage interconnected with the vacuum generating apparatus, the contaminant-laden air being drawn in through an inflow passage interconnected with the suction brush;

a dust receptacle removably connected to an underside of the cyclone unit, for collecting the contaminants separated from the air by the cyclone unit;

a locking unit which is longitudinally movable for connecting to and separating the dust receptacle from a lower portion of the cyclone unit by releasably moving the dust receptacle upward and downward; and a means for preventing an incorrect connection of the dust receptacle to the underside of the cyclone unit.

2. The upright type vacuum cleaner of claim 1, wherein the incorrect connection preventing means comprises:

a position guiding pin protruding from a predetermined location of a lower portion of the dust receptacle; and a guide slit formed at a predetermined position of the locking unit for either interrupting the pivoting of the locking unit, or for guiding the dust receptacle being transposed from a pre-mounting state to separated condition from the cyclone unit, depending on the position of the dust receptacle pre-mounted in the cyclone unit.

3. The upright type vacuum cleaner of claim 1, wherein the locking unit further comprises:

an operation lever pivotally mounted on the cleaner body; and a locking disc moved upward or downward according to the pivoting direction of the operation lever to move the dust receptacle upwardly to engage the cyclone unit or downwardly to disengage from the cyclone unit.

4. The upright type vacuum cleaner of claim 3, wherein the incorrect connection preventing means comprises:

a position guiding pin protruding from a predetermined location of the lower side of the dust receptacle; and a guide slit formed in the operation lever, for providing an interrupting function of the pivoting of the operation lever, or for guiding the dust receptacle being transposed from a pre-mounting state to separate from the cyclone unit, according to the position of the dust receptacle pre-mounted in the cyclone unit.

5. The upright type vacuum cleaner of claim 4, wherein the guide slit further comprises:

a first guide slit formed in an upper surface of the operation lever having a predetermined width, such that the guide pin is passed through the first guide slit during pivoting of the operation lever when the dust receptacle is in a normal position;

a second guide slit extending from the first guide slit and crossing the direction of pivoting of the operation lever for guiding the guide pin to separate the dust receptacle from the cyclone unit when the dust receptacle is incorrectly mounted; and an interruption groove formed between the first and second guide slits, for interrupting the guide pin during the pivoting of the operation lever to thereby interrupt the pivoting, when the dust receptacle is in an abnormal position.

* * * * *